US010125946B2

(12) United States Patent
Meerbeek et al.

(10) Patent No.: US 10,125,946 B2
(45) Date of Patent: Nov. 13, 2018

(54) LUMINAIRE AND A METHOD FOR PROVIDING TASK LIGHTING AND DECORATIVE LIGHTING

(71) Applicant: PHILIPS LIGHTING HOLDING B.V., Eindhoven (NL)

(72) Inventors: Berent Willem Meerbeek, Eindhoven (NL); Elsemieke Carola Manon Kuijpers, Eindhoven (NL); Inge Van De Wouw, Eindhoven (NL); Jochen Renaat Gheluwe, Eindhoven (NL); Anthonie Hendrik Bergman, Eindhoven (NL); Bram Knaapen, Eindhoven (NL); Tim Dekker, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 43 days.

(21) Appl. No.: 15/515,668

(22) PCT Filed: Sep. 30, 2015

(86) PCT No.: PCT/EP2015/072612
§ 371 (c)(1),
(2) Date: Mar. 30, 2017

(87) PCT Pub. No.: WO2016/050872
PCT Pub. Date: Apr. 7, 2016

(65) Prior Publication Data

US 2017/0299146 A1 Oct. 19, 2017

(30) Foreign Application Priority Data

Oct. 1, 2014 (EP) ..... 14187261

(51) Int. Cl.

| | |
|---|---|
| ***F21V 7/00*** | (2006.01) |
| ***F21S 8/00*** | (2006.01) |
| ***F21S 8/06*** | (2006.01) |
| ***H05B 33/08*** | (2006.01) |
| ***H05B 37/02*** | (2006.01) |
| *F21Y 113/00* | (2016.01) |
| *F21Y 115/10* | (2016.01) |

(Continued)

(52) U.S. Cl.
CPC ..... *F21V 7/0016* (2013.01); *F21S 8/033* (2013.01); *F21S 8/06* (2013.01); *F21S 8/061* (2013.01);

(Continued)

(58) Field of Classification Search
CPC .... F21V 7/0016; F21V 7/0033; F21V 7/0025; F21V 7/0041; F21V 7/00; F21V 7/0008;

(Continued)

(56) References Cited

U.S. PATENT DOCUMENTS 3,201,582 A 8/1965 Siegel et al.
5,195,870 A 3/1993 Liu (Continued)

FOREIGN PATENT DOCUMENTS

CH 193757 A 10/1937
CH 197416 A 7/1938

(Continued)

*Primary Examiner* — Bao Q Truong

(57) ABSTRACT

A luminaire comprises a first lighting module for providing a first lighting effect such as task lighting. The first lighting module has a front light exit face and a support structure with a rear reflective portion. A second lighting module is for providing a second lighting effect such as decorative lighting, directed to the reflective portion of the support structure. The luminaire is capable of producing the two different lighting effects in different directions.

13 Claims, 4 Drawing Sheets

(51) Int. Cl.

| | |
|---|---|
| *F21Y 107/90* | (2016.01) |
| *F21Y 113/13* | (2016.01) |
| *F21S 10/00* | (2006.01) |
| *F21S 10/02* | (2006.01) |

(52) U.S. Cl.
CPC ..... *H05B 33/0845* (2013.01); *H05B 33/0857* (2013.01); *H05B 37/0272* (2013.01); *F21S 10/007* (2013.01); *F21S 10/023* (2013.01); *F21Y 2107/90* (2016.08); *F21Y 2113/00* (2013.01); *F21Y 2113/13* (2016.08); *F21Y 2115/10* (2016.08)

(58) Field of Classification Search
CPC .... F21S 8/033; F21S 8/06; F21S 8/061; F21S 10/007; F21S 10/023; H05B 33/0845; H05B 33/0857; H05B 37/0272; F21Y 2107/90; F21Y 2113/13; F21Y 2115/10; F21Y 2113/00
See application file for complete search history.

(56) References Cited

U.S. PATENT DOCUMENTS

| | | | | |
|---|---|---|---|---|
| 6,318,880 | B1 | 11/2001 | Siminovitch et al. | |
| 6,843,586 | B1 | 1/2005 | Allaire | |
| 8,002,446 | B1 | 8/2011 | Plunk et al. | |
| 2008/0205054 | A1 | 8/2008 | Ho | |
| 2012/0140468 | A1 | 6/2012 | Chang | |
| 2013/0003387 | A1 | 1/2013 | Shih et al. | |
| 2013/0107502 | A1 | 5/2013 | Leadford | |
| 2014/0145081 | A1* | 5/2014 | Schmidt | G01J 5/0025 250/338.3 |
| 2015/0211710 | A1* | 7/2015 | Speier | F21S 8/04 362/606 |

FOREIGN PATENT DOCUMENTS

| | | | |
|---|---|---|---|
| CN | 2545478 | Y | 4/2003 |
| CN | 102042623 | A | 5/2011 |
| DE | 10210045394 | A1 | 3/2012 |
| EP | 2716964 | A2 | 9/2014 |
| JP | S6097503 | A | 5/1985 |
| JP | 2005142058 | A | 6/2005 |
| JP | 2007042461 | A | 2/2007 |
| JP | 2010170959 | A | 8/2010 |
| JP | 2010238407 | A | 10/2010 |
| JP | 2012104476 | A | 5/2012 |
| JP | 2012155939 | A | 8/2012 |
| JP | 2014099310 | A | 5/2014 |
| WO | WO2010004495 | A2 | 1/2010 |
| WO | WO2013091654 | A1 | 6/2013 |

* cited by examiner

LUMINAIRE AND A METHOD FOR PROVIDING TASK LIGHTING AND DECORATIVE LIGHTING

CROSS-REFERENCE TO PRIOR APPLICATIONS

This application is the U.S. National Phase application under 35 U.S.C. § 371 of International Application No. PCT/EP2015/072612, filed on Sep. 30, 2015, which claims the benefit of European Patent Application No. 14187261.4, filed on Oct. 1, 2014. These applications are hereby incorporated by reference herein.

FIELD OF THE INVENTION

This invention relates to interior lighting systems.

BACKGROUND OF THE INVENTION

People generally prefer daylight over artificial light as their primary source of illumination. Everybody recognizes the importance of daylight in our daily lives. Daylight is known to be important for people's health and well-being.

In general, people spend over 90% of their time indoors, and often away from natural daylight. There is therefore a need for artificial daylight sources that create convincing daylight impressions with artificial light, in environments that lack natural daylight including homes, schools, shops, offices, hospital rooms, and bathrooms.

There has been significant development of lighting systems which try to emulate daylight even more faithfully. For example, such lighting systems are used as artificial skylights, which attempt to emulate natural daylight that would be received through a real skylight. To enhance the realism of the artificial skylight, the skylight solution is usually mounted in a recess in the ceiling, in the same way that a real skylight would be mounted.

One approach which has been proposed previously by the applicant is to create a blue (i.e. clear sky) appearance when looking at a skylight at an angle, for example 40 to 90 degrees, but still emit mainly white light in a beam directed parallel to the normal direction of the skylight surface, i.e. downward. This provides functional white light in a downward direction and more blue light at angles to the normal.

It has also been recognized that it would be desirable to enable the color temperature to be selectable or even to evolve over time, so that the evolution of the color point of natural daylight can be emulated, or indeed a specific color point can be selected. However, this requires a more complex light source and associated control system.

SUMMARY OF THE INVENTION

The invention is defined by the claims.

According to an aspect of the invention, there is provided a luminaire, comprising:

a first lighting module, comprising a support structure having first and second opposite surfaces and a first light source coupled to the first surface of the support structure for providing a first lighting effect at a first location from an exit region, wherein a portion of the second surface of the support structure is reflective;

a second lighting module, comprising a second light source for providing a second lighting effect at a second location wherein the second light source is coupled to the second surface of the support structure, a reflector mounted at a distance from the second lighting module and directed to the reflective portion, wherein the second lighting module is directed to the reflector.

This luminaire combines two lighting modules, one for a first lighting effect such as task lighting and one for a second lighting effect such as decorative lighting. Because the reflective portion of the second surface of the support structure faces away from the light exit region, the second lighting effect is essentially reflected off the back of the first lighting module. The reflective portion can be provided with a desired surface effect to create a desired second lighting effect, for example to emulate naturally arising lighting effects, such as reflections from a water surface. However, as the reflective portion is opposite the light exit region of the first lighting module, it is hidden from view. In this way, the two lighting modules are combined in a way that reduces the number of components needed and also enables freedom in the design of the appearance of the overall luminaire.

The second (e.g. decorative) lighting feature can easily be applied to a broad range of luminaires and can be easily added as a decorative feature to functional luminaires. It can be used to create more pleasant and inspiring indoor lighting atmospheres.

The second lighting module is for example adapted to provide a substantially collimated light output. This is effective for generating a desired lighting effect after reflection by the reflective portion. For example, the second lighting module may be adapted to provide a light output with an output beam angle less than 20 degrees.

The second lighting module may comprise an array of LEDs. These can produce the desired narrow beam output, and they can also be controlled dynamically in color and intensity to produce dynamic decorative lighting effects. The array may comprise a line, circle, oval, or a random grid, for example chosen to match the design of the reflective portion.

The reflective portion may comprise a structured surface for generating a lighting pattern. The illusion of a moving pattern can be created by controlling the intensity in a dynamic way. The reflective portion may comprise glass, aluminum or plastic, and different materials and surface structures can be used to give rise to different effects. The reflective portion may even be provided as a removable component, so that different second (e.g. decorative) lighting effects can be implemented by changing the reflective portion.

The first light source may comprise a compact fluorescent lamp, LED arrangement or OLED arrangement. Generally, the degree of control needed for the first lighting effect, if it is task light, may be less than for the second lighting effect, if it is decorative light. For example a much slower dynamic control of the color or color temperature and intensity may be required for a task lighting effect than for a decorative lighting effect.

A controller is preferably provided for controlling the first and second light sources. The controller is for example adapted to control independently the color and the intensity of each light source, and one or both light sources may further comprise independently controllable sub-elements.

For example, the second light source may comprise an array of lighting elements, and the controller is adapted to control independently at least the intensity of each lighting element of the second light source. The individual elements may have fixed color (e.g. RGB LEDs), but the color output can then be adjusted by selecting the combinations of lighting element intensities. Note that each "lighting element" may be a single LED but it may also be a cluster of LEDs. Thus, the control is at a finer level than the overall light source, but it does not necessarily need to be at the level of each individual LED. If one element is an RGB set, then the color and intensity of the cluster output can be controlled. One independently controlled element may instead be a group of such clusters. The control at the level of these elements allows dynamic patterns to be created. The first light source may also comprise an array of lighting elements, and these may or may not be independently controllable. For example, dynamic effects may be desired only for the second lighting effect (e.g. the decorative effect) even if the first light source is also an array of LEDs to achieve the desired brightness.

A dynamic pattern can then appear to move based on dynamic control of these individual light sub-elements, without the use of physically moving parts in the luminaire.

The controller may be adapted to implement three modes of operation:

a task lighting mode using only the first lighting module;

a decorative lighting mode using only the second lighting module; and a combined lighting mode using the first and second lighting modules.

In a first example, the second lighting module is for ceiling mounting, and the luminaire comprises a suspension structure for suspending the first lighting module beneath the second lighting module, wherein the exit region is at the bottom of the first lighting module and the reflective portion is at the top of the first lighting module.

This arrangement defines a pendant lamp, in which the top of the suspended first lighting module is used as a reflector to reflect light from a ceiling mounted second lighting module, above the first. This top part of the support structure may for example comprise the back of a light shade which forms part of the over support structure of the first lighting module. The term "support structure" should be understood accordingly. It comprises the infrastructure of the first lighting module. The first light source may be mounted on the support structure (e.g. a carrier plate) or the support structure may be a part of the first lighting module which does not directly carry the light source, such as a light shade.

In a second example, the luminaire comprises:

a suspension structure for suspending the luminaire from a ceiling; and a reflector for mounting at the ceiling where the suspension structure is to be connected to the ceiling, wherein:

the exit region is at the bottom of the first lighting module;

the reflective portion is at the top of the first lighting module;

the second lighting module is mounted at the top of the first lighting module and is directed to the reflector; and the reflector is directed to the reflective portion.

This defines another version of a pendant lamp, in this version, the two lighting modules form a single unit, with the second module mounted on top of the first. An additional reflector is used to redirect the light back from the second lighting module to the reflective portion of the first module.

In a third example, the luminaire comprises a suspension structure for suspending the luminaire from a ceiling, wherein the exit region is at the bottom of the first lighting module and the reflective portion is at the top of the first lighting module, and wherein the second lighting module is mounted at the top of the first lighting module, and is directed radially outwardly around the suspension structure towards the reflective portion.

This defines another version of a pendant lamp, in which the second module is mounted on top of the first, and provides light to the reflective portion by directing the decorative light radially. This avoids the need for a further reflector.

In these examples, the second lighting module may comprise an annular ring (circular or oval or other closed shape) of LEDs, for example around the suspension structure (i.e. the electrical supply cable).

In a fourth example, the luminaire is adapted for wall mounting, wherein:

the support structure comprises a carrier plate having first and second opposite surfaces which carries the first lighting module facing outwardly coupled to the first surface, the second lighting module is coupled to the second surface of the support structure, and a mounting plate for mounting the luminaire, wherein a portion of the second surface of the support structure is reflective, and a portion of the mounting plate is reflective and directed to the reflective portion of the second surface of the support structure.

This provides a design in which the second lighting effect uses reflected light from the back of a wall mounted unit. This reflected light will then create a pattern on the wall behind the luminaire.

In a fifth example, the luminaire is adapted for wall mounting, wherein:

the support structure comprises a carrier plate having first and second opposite surfaces and the first lighting module coupled to the first surface, wherein the portion of the second surface of the support structure is reflective;

the second lighting module is coupled to the second surface of the support structure; and the luminaire further comprises a reflector above the second surface of the support structure for redirecting the decorative lighting back towards the reflective portion of the second surface of the support structure.

This provides a design in which the second lighting effect is provided upwardly and the first lighting effect (e.g. task light) is provided downwardly. The second lighting effect may be directed to provide an effect on the wall above the luminaire.

The invention also provides a method of providing first and second lighting effects using a luminaire, the method comprising:

providing a first lighting effect at a first location using a first lighting module, comprising a support structure having first and second opposite surfaces and a first light source coupled to the first surface of the support structure for providing the first lighting effect to the first location from an exit region; and providing a second lighting effect using a second lighting module, comprising a second light source for providing the second lighting effect to the second location, wherein the second lighting source is coupled to the second surface of the support structure, wherein the method comprises directing the output of the second light source to a reflective portion of the second surface of the support structure facing away from the exit region.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a luminaire comprising a first lighting module for providing a first lighting effect such as task lighting. The first lighting module has a front light exit face and a support structure with a rear reflective portion. A second lighting module is for providing a second lighting effect such as decorative lighting, directed to the reflective portion of the support structure. The luminaire is, for example, capable of producing decorative lighting in one direction and functional light in a different direction. However, both lighting effects may be for task lighting or they may both be decorative lighting.

As mentioned above, it is known to emulate natural light using an interior luminaire. Generally, it is known to match the color and evolution of color which occurs in a natural outdoor environment.

This invention is based on studies which show that there are other natural light effects which people find attractive. For example, apart from the feeling that there is a view to the outside, and there is sunlight coming through a window, other natural light phenomena are important. Examples are the effects caused by the reflection of natural light on water, or sharp patterns on walls and ceilings arising from direct sunlight through windows. The invention aims to create electric lighting solutions for indoor environments inspired by these natural light effects, such as reflections.

Several attempts have been made to create lighting solutions that provide these nature-inspired light effects. For example, it has been proposed to use a parallelogram-shaped LED panel that is mounted in a wall to create the illusion of a sunlight pattern on the wall. The use of a pixelated LED panel has also been proposed that can show dynamic daylight patterns, for example to create the illusion of a reflection of sunlight through leaves. Another example is a ripple effect which can be achieved based on the interaction of light with a rotating glass structure, resulting in patterns on a wall. Projection systems have also been developed which project various scenes on a ceiling, such as an underwater scene and a forest scene.

Although some of these concepts can provide attractive lighting effects, they often come with several problems. Often, relatively expensive lighting technology is required, such as a projector or a matrix of many LEDs, or fragile mechanical components. Furthermore, these solutions might require severe infrastructural changes before installing the systems if they are to provide functional lighting.

This invention aims to create attractive dynamic light patterns at a low cost compared to alternative solutions.

Figure 1:
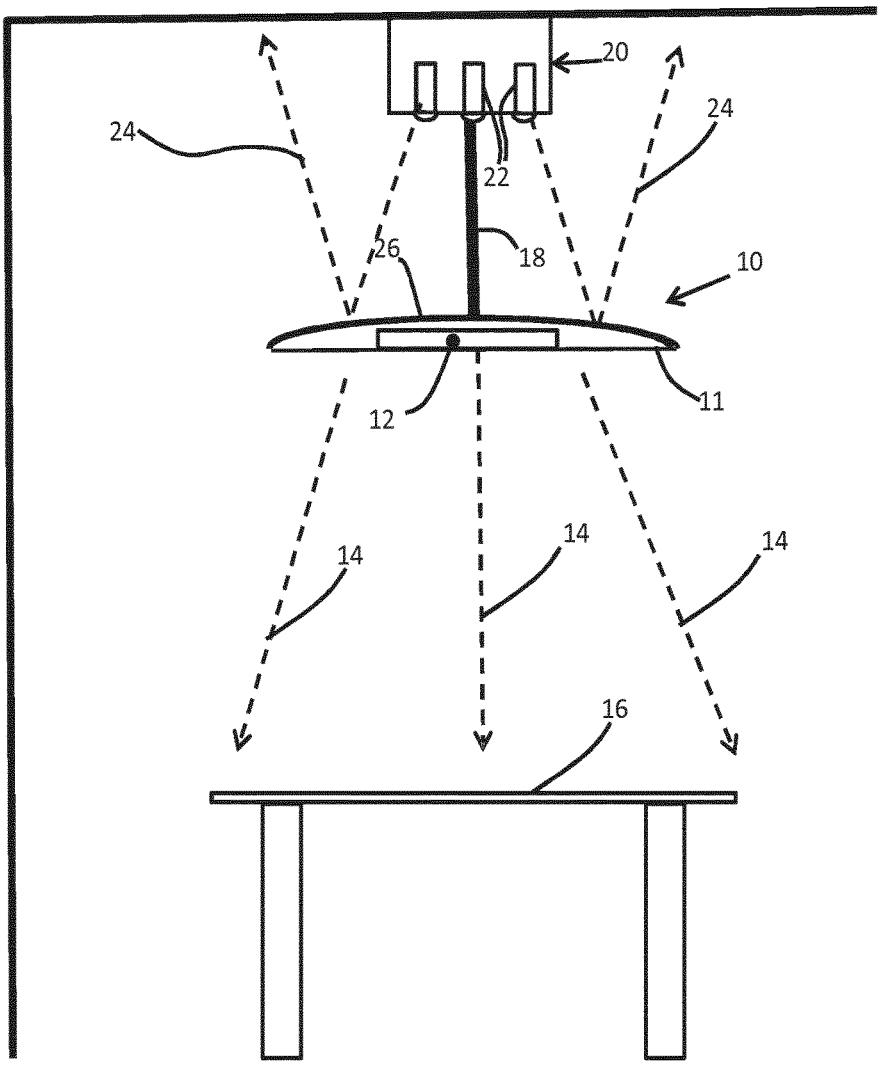
FIG. 1 shows a first example of luminaire for providing task lighting and decorative lighting.

FIG. 1 shows a system in accordance with a first example of the invention. This example comprises a pendant lamp arrangement.

The luminaire has a first lighting module 10, comprising a support structure 11 and a first light source 12 carried by the support structure 11 for providing task lighting 14 to a task area 16 from a light exit region of the first lighting module. The support structure is essentially a housing, in which, or on which, the first light source is mounted. The first lighting module is suspended from the ceiling in use by a suspension structure 18 which provides mechanical support as well as providing electrical power to the lighting module.

A second lighting module 20 comprises a second light source 22 for providing decorative lighting 24.

The support structure 11 of the first lighting module 10 has a reflective portion 26 opposite the exit region from which light is output. The second light source 20 has its optical output directed to this reflective portion 26 of the support structure 11.

The first lighting module 10 is for creating task lighting. The light output can be entirely conventional.

The second lighting module is for creating decorative lighting effects and is positioned at a certain distance from the first lighting module. In the example shown, the second lighting module 20 is mounted on the ceiling where the suspension structure 18 is attached. The second light source 22 comprises one or more individually addressable light sources, each individual light source having highly collimating optical elements to create a narrow beam angle. These light sources are directed towards the reflective portion 26 on the back of the support structure 11. This reflective portion may be the entire upper surface, or it may be a portion which will be illuminated in use by the second light source 22.

The reflective portion 26 reflects the light of the second lighting module towards an area on which the decorative patterns are shown, for example a ceiling or wall. The reflective surface ideally is highly reflective and has a particular structure such that the interaction with the narrow light beams generated by the second lighting module produces complex high resolution reflected light patterns. The exit region on the opposite side of the first lighting module emits functional light in a different direction to the reflected light from the second lighting module. This different direction may be the opposite direction but this is not essential, and the reflective portion may reflect light to a lateral rather than upward direction.

A control module allows adjustment of the light parameters for each of the two lighting modules, such as color, color temperature and intensity over time to create dynamic patterns. Furthermore, the control module allows switching between a decorative mode (in which only the second lighting module is on), a functional mode (in which only the first lighting module is on) or a combined mode (in which both lighting modules are on).

The second lighting module for creating a decorative light effect typically consists of multiple individually controllable LEDs. These LEDs typically have a narrow beam (for example, <20 degrees) in order to create sharp patterns with high contrast and visible details. Other directional light sources can be used instead of LEDs, such as halogen spots or lasers. These light sources are directed towards the reflective portion 26.

This reflective portion 26, is for example constructed of a highly reflective material with an irregular structure to create high contrast and highly detailed light patterns on the area of interest. For example, glass, aluminum, or plastics maybe used. The type of material and in particular its surface structure is selected to define a desired visual appearance of the pattern. For example, a more regular structure will result in a more regular pattern. Sharp edges in the material will result in patterns with high contrast (i.e., more collimated reflections). The reflective portion may have surface roughness, holes, wrinkles, dimples etc.

In addition to the surface pattern, other parameters that define the appearance of the pattern include the distance between the decorative second light source 22 and the reflective portion 26 and the distance between the reflective portion 26 and the area where the light pattern is displayed, e.g. wall or ceiling. Increasing these two distances will generally result in larger but less intense patterns than with lower distance values. The shape of the reflector of course also influences the decorative lighting effect. A flat surface will result in a different pattern to a concave or convex surface. For example, a convex surface will spread the pattern over a large surface, while a concave surface will focus a pattern more.

The control module allows light parameters for each of the two lighting modules to be adjusted, such as color, color temperature and intensity over time to create dynamic patterns. Various methods can be used to control the dynamic light behavior. With software, the behavior of the lights can be scripted (e.g. by a lighting designer), or programmed by a mathematical function that defines the light behavior (e.g. using Markov Chain models).

The controller may also automatically create a lighting behavior based on some input parameters (e.g. user input or sensor input). For example, the intensity of the lights could increase with sunny weather outside, and the speed of the light variations may depend on the wind speed. Important control parameters that define the dynamic appearance of the light pattern are the amplitude and the frequency of variation of the light parameters such as intensity, color and color temperature. In general, larger amplitudes and higher frequencies will results in patterns that are perceived as more intense, dynamic, etc., while smaller amplitudes and lower frequencies will result in calmer, more relaxed patterns.

Besides these temporal characteristics, also the spatial dynamics may be used, by which is meant the way the light sources at different locations are controlled. For example, in the case of two LEDs placed 5 cm from each other, one could alternately switch them on and off resulting in a jumping pattern, or have a smooth transition by decreasing the intensity of one light while at the same time increasing the intensity of the other light resulting in cross fading of the pattern.

The example of FIG. 1 is a pendant luminaire for example for positioning above a task area such as a dining table 16.

The second lighting module 20 in this example is for creating decorative light effects on the ceiling and it is mounted at or just below the ceiling. In one example it comprises six individually addressable high power LED light sources, each with an individual optical beam shaping output element to create a narrow beam for example of 8 degrees. The LEDs are placed in a circle with a diameter for example of 10 cm and with an equal distance between the LEDs. The LEDs are directed downwardly towards the reflective portion 26. Less or more light sources can be used, with a trade-off between cost, light output, and resolution of the decorative pattern.

The first lighting module 10 is for example positioned at a distance of 80 cm below the second lighting module. The optimal distance depends on the application environment and the desired effect. The light source 12 of the first lighting module creates functional or task lighting on the table. The light source 12 may be a compact fluorescent lamp, but an LED, OLED, or other type of light source may be used.

The intensity of the multiple high power LEDs can preferably be controlled individually, for example using a DMX ("digital multiplex") lighting protocol. By dynamically changing the intensity levels of the individual LEDs the illusion of a moving pattern can be created without any physically moving parts. By changing the period and the amplitude of the intensity changes, as well as the amount and order in which the LEDs are switched on and off, various dynamic patterns can be created.

In addition to pendant luminaries, the same concepts can be applied to many other luminaire types, including floor standing, desk and table lamps, and wall-mounted fixtures. Some alternative embodiments will now be discussed. The same reference numbers are used in all figures to denote the same components.

In the example of FIG. 1, the second lighting module 20 is a separate part to the first module 10. The example of FIG. 2 combines the two lighting modules into one luminaire. The LEDs 22 of the second lighting module, for the dynamic pattern effect, are placed at a module on the top side of the pendant luminaire housing 11, for example on top of a light shade. The LEDs (i.e. the second light source 22) emit light in an upward direction towards a mirror 30 which is mounted at the ceiling. The collimated light beams from the decorative LED source 22 are reflected by this mirror 30 towards the top of the luminaire shade which has the reflective portion 26. The top mirror 30 may be curved to direct the decorative light 24 to a defined part of the housing 11 of the first lighting module, i.e. the lamp shade in this example. The top mirror 30 is for example positioned at a distance of 80 cm above the second lighting module. The optimal distance depends on the application environment and the desired effect. As a result, the light is reflected from the top reflective portion 26 towards the ceiling and appears as a decorative dynamic light effect.

Figure 2:
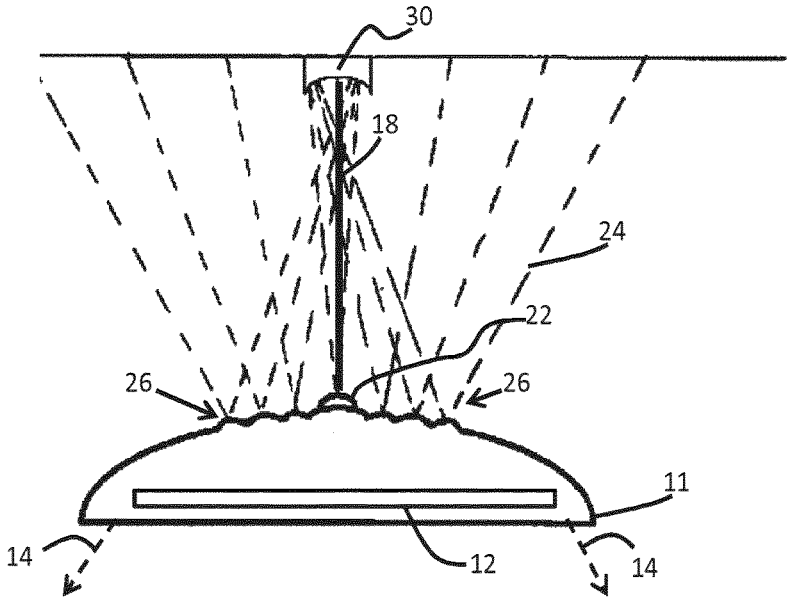
FIG. 2 shows a second of luminaire for providing task lighting and decorative lighting.
Figure 3:
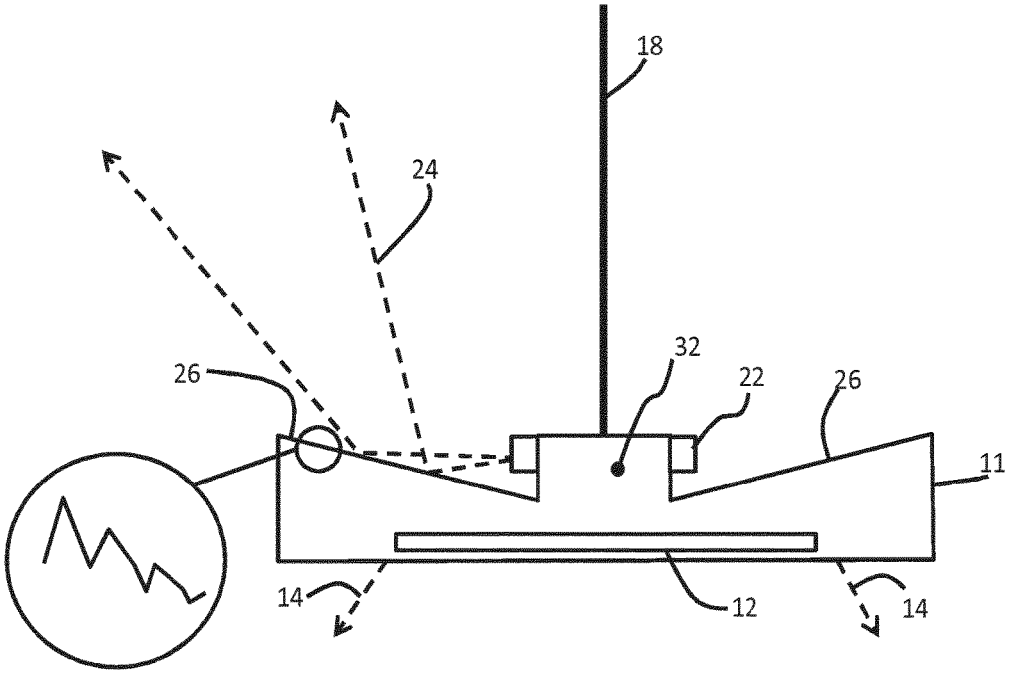
FIG. 3 shows a third example of luminaire for providing task lighting and decorative lighting.

The examples of FIGS. 1 and 2 require two separate components to be mounted. FIG. 3 shows an example of pendant luminaire with side-emitting LEDs 22. These enable the LEDs for providing the dynamic decorative lighting again to be incorporated in the main body of the luminaire. However, this design avoids the need for two separate units to be installed. The reflective portion is again at the top of the first lighting module, and the light source 22 of the second lighting module is mounted at the top of the first lighting module. The LEDs 22 surround a collar 32 so that they are directed generally radially outwardly, and they are directed towards the reflective portion 26. The reflective portion in this case is an inclined face for redirecting the radial light to a generally upward direction. The reflective portion thus reflects the light upwards to create the decorative light effect. The surface may be curved to direct the light to a particular part of the ceiling. The light sources can again be placed in a circular arrangement around the axis of the collar 32. They may be directed horizontally or at an elevation angle to provide the suitable direction of light to a particular part of the reflective portion 26.

The examples above are all suspended pendant luminaires.

Figure 4:
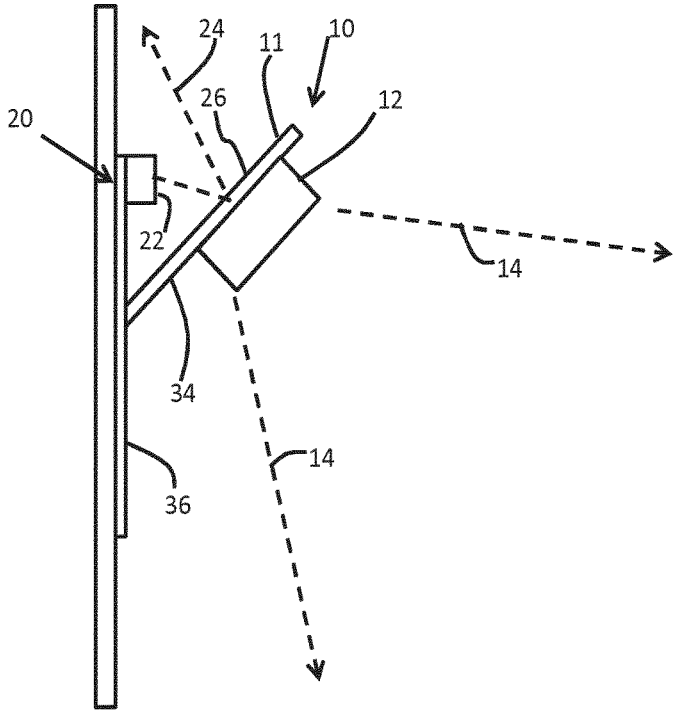
FIG. 4 shows a fourth example of luminaire for providing task lighting and decorative lighting.

FIG. 4 shows a first wall-mounted design.

The functional task lighting is provided in a generally downwards direction by the first lighting module 10, and decorative lighting is provided by the second lighting module 22 in a generally upward direction. The task lighting enters a room space and the decorative lighting is directed to the wall on which the unit is mounted.

The support structure 11 in this case comprises a mounting bracket having first and second opposite sides. The first light source 12 is on the side of a bracket arm 34 facing the room. This bracket arm 34 functions as a carrier plate. The back of that bracket arm 34 defines the second surface of the support structure, wherein a portion of the bracket arm is reflective. The second light source 22 is coupled to the second surface of the bracket arm 34. A portion (30) of the mounting plate 36 is reflective and directed to the reflective portion 26 of the second surface of the support structure 11. The second light source 22 faces the reflective portion 30 of the mounting plate which reflects the light 24 back against the bracket arm 34 and also upwardly.

Figure 5:
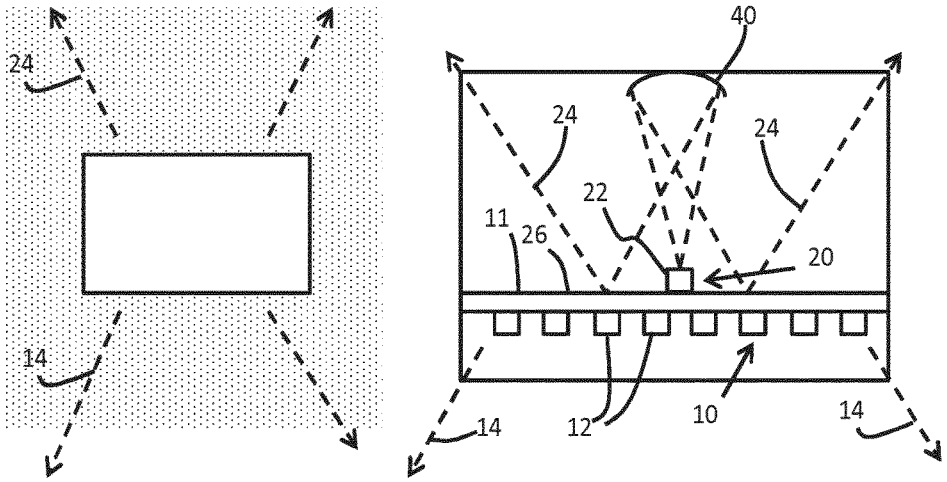
FIG. 5 shows a fifth example of luminaire for providing task lighting and decorative lighting.

FIG. 5 shows a second wall-mounted design.

The left image shows a front view. It comprises a decorative light fitting, in which the light sources are not visible. The task light 14 is emitted downwardly and the decorative light 24 is emitted upwardly. The luminaire is covered by an aesthetic front cover.

The right image shows the inside components, again as a front view.

The support structure 11 comprise a carrier plate having the first (task) light source 12 underneath and the second (decorative) light source 22 on top. A mirror 40 is used inside the luminaire housing to reflect the light from the second light source or sources 22 back to the reflective portion of the carrier plate 11. From the reflective portion 26, the light travels in an upwards direction towards the wall. The mirror 40 may be curved to direct the light to (a smaller part of) the reflective material.

Figure 6:
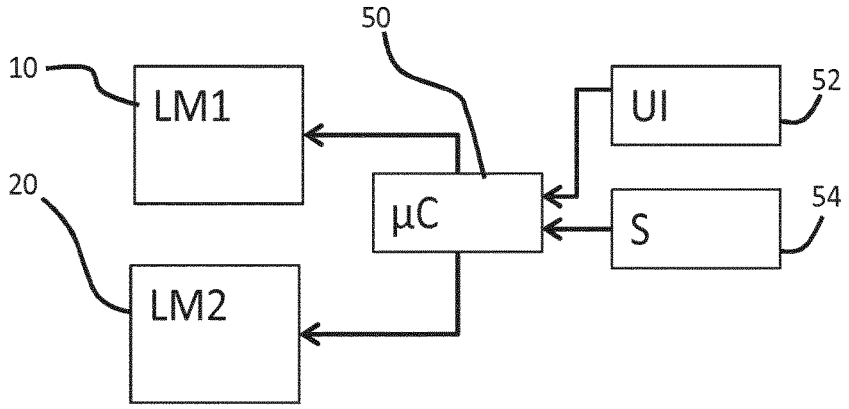
FIG. 6 shows the control circuit used in the luminaire.

FIG. 6 shows in simplified schematic form the overall lighting system, which comprises the first lighting module 10 (LM1), the second lighting module 20 (LM2) and a controller 50. The controller 50 can receive inputs from a user interface 52 and optionally also from sensors 54. These sensors may detect temperature, ambient light levels, other information about ambient light such as color temperature, wind speed, presence detection, time of day etc. The controller may receive commands using wireless RF protocols, so that for example the link between the user interface and the controller may be a wireless RF link. The luminaire may for example be controlled by a mobile phone such as a smart phone.

The light sources have not been described in detail above. Colored LEDs or color filters can be used to create more colorful dynamic light patterns. For example a disk with red, amber, warm white and cool white color filters can be used to simulate different tints of natural daylight (or a warm fireplace effect), or blue, white and green filters can be used to create underwater scenes.

The reflective portion 26 may be supplied separately to the remainder of the luminaire, to allow a selection of decorative lighting effects. The reflective portion provided may have predetermined raised structures, folds or dents, or else a smooth planar structure may be provided for the end user to work the surface such as to personalize the decorative lighting effect. This gives the option to have many or few lighting effects, over a large area or more contained, and with strong or gentle impact. Local color filters, or other pattern creating elements may be selected by the end user. In combination with user definable dynamics, a wide range of fascinating light effects can be created.

By using light sources with different spectral properties, the total light output can be spectrally tuned to match the desired setting. For example, a relaxing pattern could use slower dynamics and lower intensities, and a spectral composition with relatively little blue and more red. An activating pattern could use faster dynamics and higher intensities, and relatively more blue light output.

Some examples in accordance with the invention thus enable decorative lighting to be provided which may for example comprise dynamic reflected light patterns. The dynamic pattern can be made to appear to be moving through individual dynamic control of collimated individual light sources directed at the reflective surface, thus avoiding the need for physically moving parts in the luminaire. The invention can easily be applied to a broad range of luminaires and can be easily added as a low-cost decorative feature to functional luminaires. It can be used to mimic dynamic (daylight) patterns to create more pleasant and inspiring indoor lighting atmospheres.

The controller 50 can be implemented in numerous ways, with software and/or hardware, to perform the various functions required. A processor is one example of a controller which employs one or more microprocessors that may be programmed using software (e.g., microcode) to perform the required functions. A controller may however be implemented with or without employing a processor, and also may be implemented as a combination of dedicated hardware to perform some functions and a processor (e.g., one or more programmed microprocessors and associated circuitry) to perform other functions.

Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media such as volatile and non-volatile computer memory such as RAM, PROM, EPROM, and EEPROM. The storage media may be encoded with one or more programs that, when executed on one or more processors and/or controllers, perform at the required functions. Various storage media may be fixed within a processor or controller or may be transportable, such that the one or more programs stored thereon can be loaded into a processor or controller.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A luminaire, comprising:

a first lighting module, comprising a support structure having first and second opposite surfaces and a first light source coupled to the first surface of the support structure for providing a first lighting effect at a first location from an exit region, wherein a portion of the second surface of the support structure is reflective;

a second lighting module, comprising a second light source for providing a second lighting effect at a second location wherein the second light source is coupled to the second surface of the support structure, a reflector mounted at a distance from the second lighting module and directed to the reflective portion, wherein the second lighting module is directed to the reflector.

2. A luminaire as claimed in claim 1, wherein the second lighting module is adapted to provide a light output with an output beam angle less than 20 degrees.

3. A luminaire as claimed in claim 1, wherein the second lighting module comprises an array of LEDs.

4. A luminaire as claimed in claim 1, wherein the reflective portion of the second surface of the support structure comprises a structured surface for generating a lighting pattern, wherein the reflective portion for example comprises glass, aluminum or plastic.

5. A luminaire as claimed in claim 1, wherein the first light source comprises a compact fluorescent lamp, LED arrangement or OLED arrangement.

6. A luminaire as claimed in claim 1, further comprising a controller for controlling the first and second light sources, wherein the controller is adapted to control independently the color and/or color temperature and/or the intensity of each light source.

7. A luminaire as claimed in claim 6, wherein at least the second light source comprises an array of lighting elements, and wherein the controller is adapted to control independently at least the intensity of each lighting element of the second light source.

8. A luminaire as claimed in claim 1, further comprising a controller for controlling the first and second light sources, wherein the controller is adapted to implement three modes of operation:

a task lighting mode using only the first lighting module;

a decorative lighting mode using only the second lighting module; and a combined lighting mode using the first and second lighting modules.

9. A luminaire as claimed in claim 1, wherein the luminaire comprises:

a suspension structure for suspending the luminaire from a ceiling; and a reflector for mounting at the ceiling where the suspension structure is to be connected to the ceiling, wherein:

the exit region is at the bottom of the first lighting module;

the reflective portion is at the top of the first lighting module;

the second lighting module is mounted at the top of the first lighting module and is directed to the reflector; and the reflector is adapted to be directed to the reflective portion.

10. A luminaire as claimed in claim 9, wherein the second lighting module comprises an annular circular or non-circular ring of LEDs.

11. A luminaire as claimed in claim 1, wherein the luminaire is adapted for wall mounting, wherein:

the support structure comprises a support structure having first and second opposite surfaces and the first lighting module coupled to the first surface facing outwardly, the second lighting module is coupled to the second surface of the support structure, and a mounting plate for mounting the luminaire, wherein a portion of the second surface of the support structure is reflective, and a portion of the mounting plate is reflective and directed to the reflective portion of the second surface of the support structure.

12. A luminaire as claimed in claim 1, wherein the luminaire is adapted for wall mounting, wherein:

the support structure having first and second opposite surfaces and the first lighting module coupled to the first surface, wherein the portion of the second surface of the support structure is reflective;

the second lighting module is coupled to the second surface of the support structure; and the luminaire further comprises a reflector above the second surface of the support structure for redirecting the decorative lighting back towards the reflective portion of the second surface of the support structure.

13. A method of providing first and second lighting effects using a luminaire, the method comprising:

providing a first lighting effect at a first location using a first lighting module, comprising a support structure having first and second opposite surfaces and a first light source coupled to the first surface of the support structure for providing the first lighting effect to the first location from an exit region; and providing a second lighting effect using a second lighting module, comprising a second light source for providing the second lighting effect to the second location, wherein the second light source is coupled to the second surface of the support structure, wherein the method comprises directing the output of the second light source to a reflector mounted at a distance from the second lighting module and then directing the output to a reflective portion of the second surface of the support structure facing away from the exit region.

* * * * *